US005769653A

United States Patent [19]

Osterbrock et al.

[11] Patent Number: 5,769,653

[45] Date of Patent: Jun. 23, 1998

[54] WIRING DEVICE CIRCUIT IDENTIFICATION

[75] Inventors: James A. Osterbrock, Central Square; Michael R. Bryndzia, Baldwinsville, both of N.Y.

[73] Assignee: Pass & Seymour, Inc., Syracuse, N.Y.

[21] Appl. No.: 853,787

[22] Filed: May 9, 1997

Related U.S. Application Data

[62] Division of Ser. No. 589,483, Jan. 22, 1996, abandoned.

[51] Int. Cl.[6] ..... H01R 3/00

[52] U.S. Cl. ..... 439/491; 29/592.1; 174/66; 40/638; 40/299

[58] Field of Search ..... 439/491; 29/592.1; 40/299, 630, 638, 316; 174/66, 53, 56

[56] References Cited

U.S. PATENT DOCUMENTS

| | | |
|---|---|---|
| D. 354,217 | 1/1995 | Sneary . |
| 2,515,820 | 7/1950 | Clark . |
| 2,625,759 | 1/1953 | Koepke . |
| 2,945,204 | 7/1960 | Berger . |
| 4,353,759 | 10/1982 | Stallings . |
| 4,479,317 | 10/1984 | Hanna . |
| 4,565,023 | 1/1986 | Carlisle . |
| 4,780,573 | 10/1988 | Own . |
| 4,800,239 | 1/1989 | Hill . |

*Primary Examiner*—Neil Abrams
*Assistant Examiner*—Daniel Wittels
*Attorney, Agent, or Firm*—Bond, Schoeneck & King, LLP

[57] ABSTRACT

A wiring device such as a switch or receptacle includes a sheet suitable for receiving markings from a pencil or ball-point pen affixed to a predetermined surface area of the device. A conventional wall plate is secured to the device by a screw passing through coaxial openings in the wall plate, the sheet and the surface area of the device and secured in a threaded opening. In the disclosed embodiment, the device is a duplex receptacle with the surface area and sheet lying between the two plug-receiving portions. Indicia placed on the sheet by the installer indicates the specific circuit, i.e., the breaker and panel, in which the device is connected.

7 Claims, 2 Drawing Sheets

36
40
40'
38
34
26
28
PANEL
BREAKER
20
16
22
24
16'
20'
18
12
14
10

WIRING DEVICE CIRCUIT IDENTIFICATION

This is a divisional Ser. No. 08/589,483 filed on Jan. 22, 1996 and now abandoned.

BACKGROUND OF THE INVENTION

The present invention relates to methods and means for identifying a specific circuit, from a plurality of circuits in an electrical installation, in which a wiring device such as a switch or receptacle is connected.

It is the usual practise when installing electrical wiring in a structure to connect a limited number of wiring devices in a single circuit, thereby reducing the possibility of exceeding the rated circuit capacity by combined loads connected to the devices. Accordingly, fuse or breaker boxes have for many years been provided with a plurality of terminals for connecting wires from one or more wiring devices to the power source in separate circuits, each having a predetermined current capacity. When this capacity is exceeded, the fuse or breaker opens to remove the danger of fire or other hazards. Many installations include a plurality of boxes or so-called panels, each having a plurality of circuits with individual breakers.

When it is necessary to repair, replace, or otherwise work in proximity to exposed wiring of a wiring device, the circuit wherein the device is incorporated should be deenergized by opening the breaker, disconnecting the wiring device from the power source. Of course, it is not normally desirable to open all circuits in an entire installation when working on only one. However, it is not always easy to identify the specific circuit in which a particular wiring device is connected.

Efforts to address this problem appear in U.S. Pat. Nos. 2,625,759 and 4,479,317. In the former, a folded blank carrying a sliding member with circuit-identifying indicia is installed under the wall plate of a device to permit the slide to be moved in and out without removing the wall plate. In the latter, a separate, transparent plate having a panel for receiving identifying indicia is installed in surrounding relation to the device, between the wall plate and the wall. Other expedients commonly used by electricians include placing the identifying indicia on the inside of the wall plate with a felt-tipped pen or highlighting marker, which is defeated if wall plates are switched or replaced and not marked, or by placing engraved panels on the wall next to the device, which is more expensive and aesthetically unpleasing. The exterior surfaces of the wiring devices themselves are normally of smooth plastic, essentially incapable of receiving and retaining markings from conventional writing instruments such as pencils and ball point pens. Also, the devices may be of a dark color such that markings are not visually apparent.

It is a principal object of the present invention to provide improved, simple and inexpensive means and methods for readily and accurately identifying the specific circuit, from a plurality of such circuits, in which a wiring device is connected.

Another object is to provide an electrical wiring device having convenient circuit identifying means which does not require any mounting or installation items other than the device and compatible wall plate.

A further object is to provide circuit-identifying means for a wiring device which does not alter the manner of installation or the installed appearance of the device or its associated wall plate.

Still another object is to provide a method and means of placing circuit-identifying indicia upon a wiring device with a smooth, plastic exterior by means of a marking instrument, such as a pencil or ball point pen, likely to be carried by or readily available to an electrician or other installer of the device.

Other objects will in part be obvious and will in part appear hereinafter.

SUMMARY OF THE INVENTION

The invention is employed in a wiring device such as a switch or receptacle of a type which would normally be mounted in a junction box behind a wall opening. The device, as is commonly the case, includes base and/or cover portions of molded, high-impact plastic having smooth exterior surfaces which are unsuitable for receiving and retaining markings from common writing instruments. Although a felt-tipped marker, or the like, may apply visible markings on such surfaces, such markings do not adhere well and may be unintentionally wiped off or smudged and thereby rendered illegible.

The invention is disclosed in the context of a duplex wall receptacle having a pair of spaced, plug-receiving portions, and a plurality of wiring terminals for connecting the device in an electrical circuit. The device is mounted in the usual manner in a wall opening and a wall plate having apertures for exposing the plug-receiving portions is removably secured to the device by a screw passing through an opening in the wall plate and received in a threaded opening in the device, also in conventional fashion.

A sheet of paper or other material having a surface suitable for receiving and retaining markings from a pencil or ball point pen is adhesively secured on its other surface to a surface area of the device between the plug-receiving portions. The opening in the device for receiving the wall plate screw is also in this surface area, and an overlying opening is provided in the attached marking sheet. Thus, when the device and wall plate are installed, the sheet is held in place not only by the adhesive, but also by the wall plate screw. Circuit-identifying indicia may be placed upon the sheet at any time prior to installation of the wall plate.

The foregoing and other features and advantages of the invention will be more readily understood and fully appreciated from the following detailed description, taken in conjunction with the accompanying drawings.

DETAILED DESCRIPTION

Figure 1:
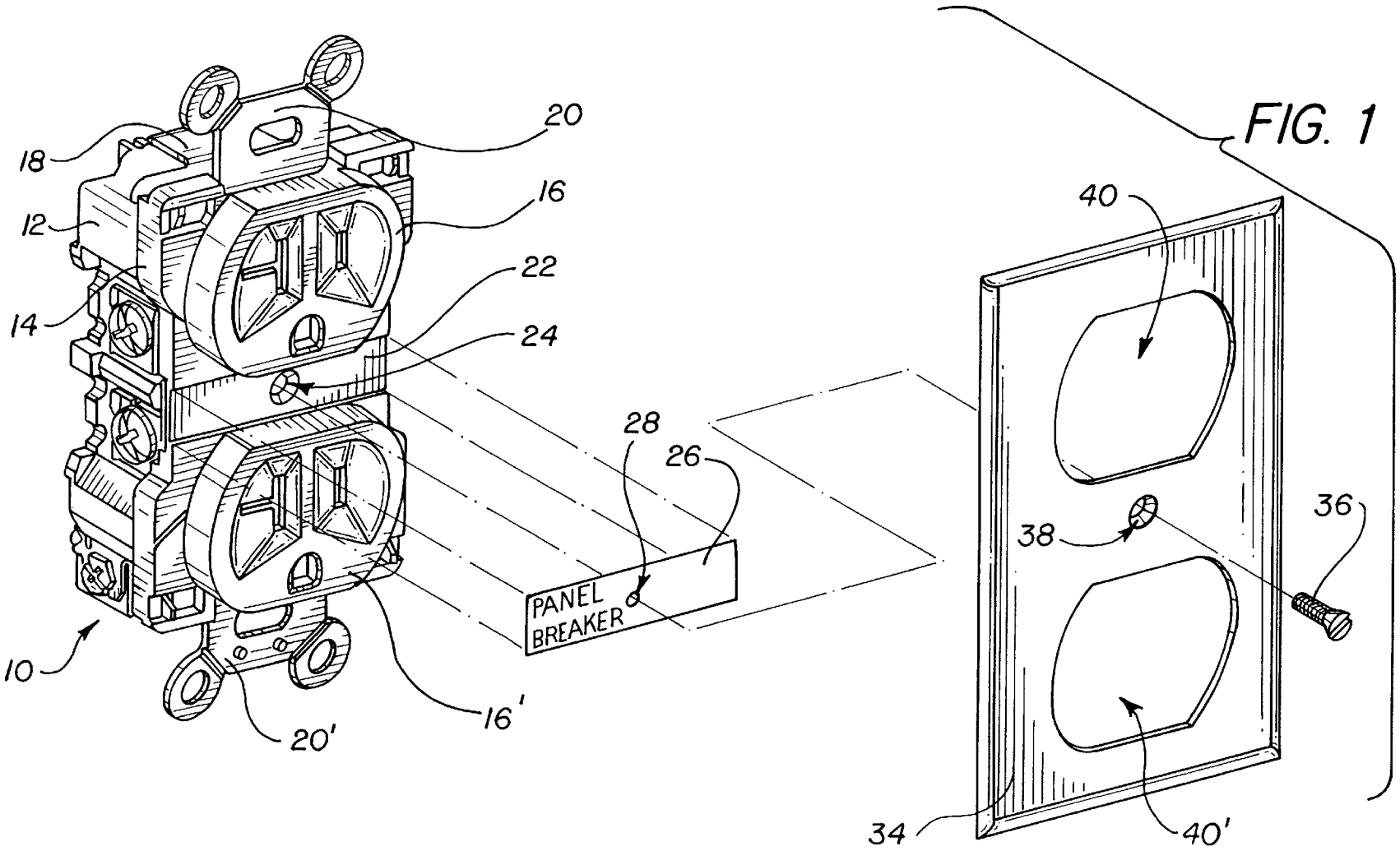
FIG. 1 is an exploded perspective view of the elements of the invention, including a duplex receptacle.

Referring now to the drawings, in FIG. 1 is shown a typical duplex wall receptacle 10, representative of the types of wiring devices wherein the present invention may be incorporated. Receptacle 10 includes base or body portion 12 and cover portion 14, both of molded plastic with smooth surfaces, essentially incapable of receiving and retaining markings from a pencil, ball point pen, or other such conventional writing implements. Cover 14 includes a pair of plug-receiving portions 16, 16' with appropriate apertures through which the blades of conventional plugs may be inserted for engagement by female electrical contacts (not shown) with base 12. Other elements of receptacle 10, including grounding strap 18, having the usual mounting ears 20, 20', are also conventional in nature and may be of any desired design.

Figure 2:
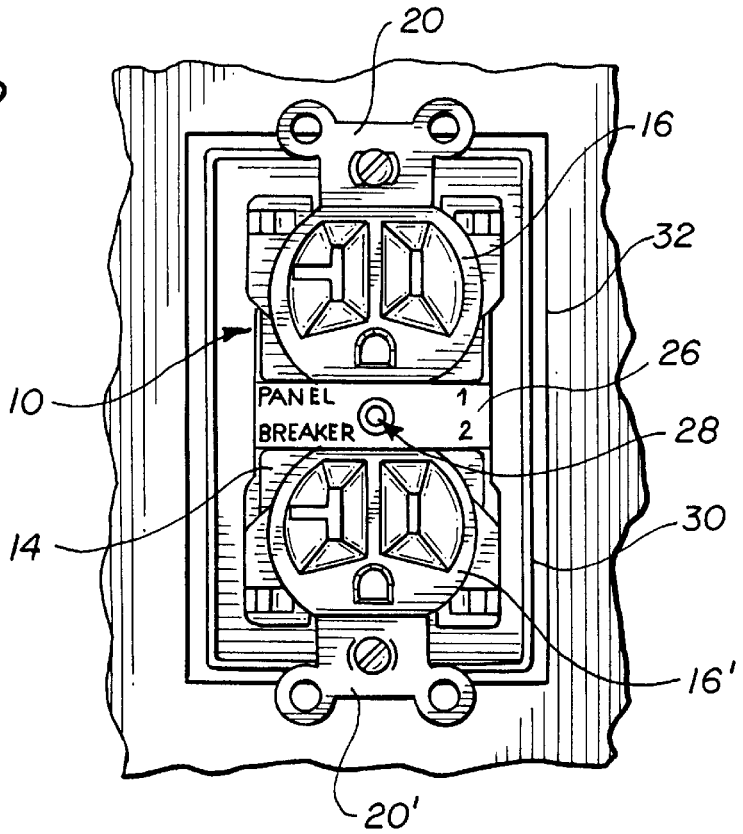
FIG. 2 is a front elevational view of the receptacle of FIG. 1, mounted in a junction box in a wall opening.

Plug-receiving portions 16, 16' are spaced from one another by surface area 22, extending laterally to the two side edges of cover 14 and preferably recessed along its upper and lower edges from the adjoining front surfaces of the cover. Opening 24 extends through the portion of cover 14 in surface area 22 and is substantially co-axial with an underlying, threaded opening in a portion of strap 18. Sheet 26, of paper or other material having a surface suited to receive and retain markings from a conventional writing instrument on the surface seen in FIGS. 1 and 2, is adhesively secured on its opposite surface to surface area 22 of receptacle 10. Preferably, the peripheral boundaries of surface area 22 and sheet 26 are substantially coextensive, and opening 28 in sheet 26 is aligned with opening 24 in cover 14.

After connection of hot and neutral wires between the appropriate terminals on device 10 and the open contacts of the circuit at the breaker panel, the device is installed in the usual manner in junction box 30 which is supported behind wall opening 32, as seen in FIG. 2. Appropriate numbers or other indicia, corresponding to assigned circuit and, when necessary, panel designations, are placed by the installer on sheet 26 either before or after installation of device 10 in box 30. Sheet 26 is preferably affixed to device 10 by the manufacturer, but may be supplied separately and affixed by the installer.

Figure 3:
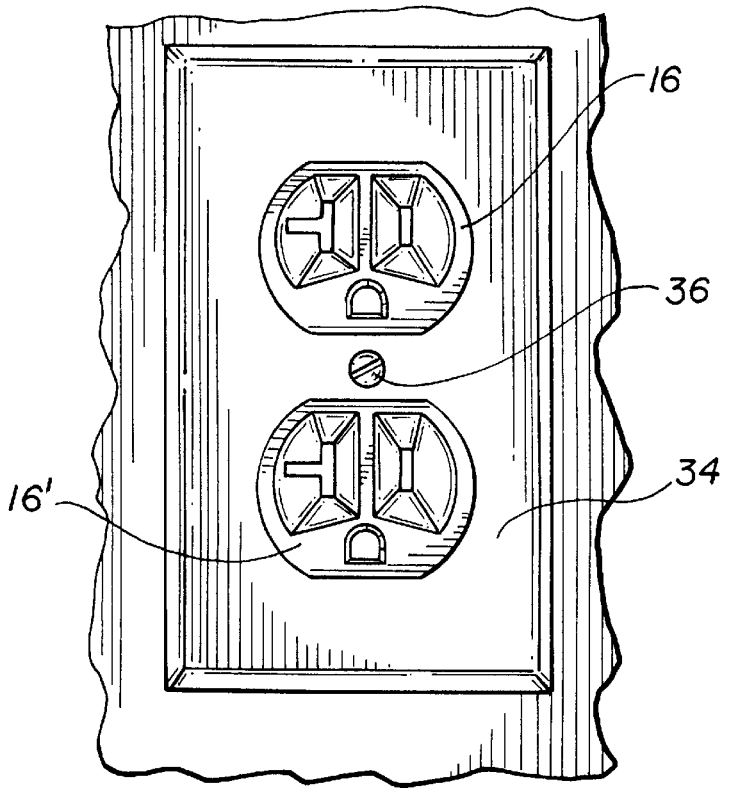
FIG. 3 is the same view as FIG. 2 after installation of a wall plate.

Subsequent to installing device 10 in box 30 and placing the indicia on sheet 26, wall plate 34 is installed in covering relation to wall opening 32 by means of screw 36 which extends through opening 38 in the wall plate, openings 28 and 24 in sheet 26 and cover 14, respectively, and is received in the threaded opening of device 10. Plug-receiving portions 16, 16' are exposed through openings 40, 40', respectively, in wall plate 34, as seen in FIG. 3. Both the manner of installation and the appearance after installation of the device and wall plate are the same as if the present invention were not employed. Since it is necessary to remove the wall plate before performing any operations on device 10 or its associated wiring after initial installation, the specific circuit breaker and box or panel to which device 10 is connected will be immediately apparent.

What is claimed is:

1. The method of identifying, from a plurality of separate circuits in an electrical installation, the specific circuit in which a wiring device is connected, said method comprising:

(a) affixing to a predetermined surface area of said device a sheet of material having an inner surface contacting said surface area and an outer surface capable of receiving and retaining visible markings from a conventional pen or pencil;

(b) electrically connecting said device in said specific circuit;

(c) installing said wall device in a wall opening with said outer surface facing outwardly;

(d) marking upon said outer surface with a conventional pen or pencil indicia uniquely associated with and thereby identifying said specific circuit: and, (e) removably securing a wall plate in covering relation to said wall opening and to portions of said device including said sheet, whereby said indicia is visible only when said wall plate is removed.

2. The method of claim 1 wherein said wall plate is secured by a screw extending through coaxial openings in said wall plate and in said sheet.

3. The method of claim 2 wherein said device is a duplex receptacle having a pair of spaced plug-receiving portions and said coaxial openings are positioned between said plug-receiving portions.

4. The method of claim 1 wherein indicia includes portions identifying both a specific breaker and a specific panel in said specific circuit.

5. The method of claim 9 wherein the step of affixing comprises adhesively securing the inner surface of said sheet of material with the predetermined surface area of said wiring device.

6. The method of claim 1 wherein said device is a duplex receptacle having a pair of spaced plug-receiving portions, said predetermined surface area has a peripheral boundary lying between the plug-receiving portions, and said sheet of material has an outer periphery, the step of affixing further comprising matching the outer periphery of the sheet of material with the peripheral boundary of the predetermined surface area.

7. A method of identifying a circuit, from a plurality of circuits, to which a wiring device is connected, comprising the steps of a) unscrewing a screw securing a wall plate to a wiring device disposed in a wall opening;

b) removing the wall plate from the wiring device to reveal a predetermined surface area on the wiring device obscured by the wall plate prior to removal of the wall plate;

c) locating an indicia containing sheet of material adhered to the wiring device in the predetermined surface area; and, d) reading indicia on the indicia containing sheet of material to identify the circuit to which the wiring device is connected.

* * * * *

UNITED STATES PATENT AND TRADEMARK OFFICE

CERTIFICATE OF CORRECTION

PATENT NO. : 5,769,653

DATED : June 23, 1998

INVENTOR(S) : James A. Osterbrock, Michael R. Bryndzia

It is certified that error appears in the above-indentified patent and that said Letters Patent is hereby corrected as shown below:

TITLE PAGE:

Under "Related U.S. Application Data",

Item [62], "Division of Serial No. 589,483; Jan. 22, 1996, abandoned"

should read

-- Division of Ser. No. 589,483, Jan. 22, 1996--

Signed and Sealed this

Sixteenth Day of February, 1999

*Attest:*

*Attesting Officer*

*Acting Commissioner of Patents and Trademarks*